US006151767A

United States Patent [19]

Gross

[11] Patent Number: 6,151,767

[45] Date of Patent: Nov. 28, 2000

[54] MAKING CANDLES

[75] Inventor: Werner Gross, Nettetal, Germany

[73] Assignee: Spezial-Maschinenfabrik Hans Kurschner GmbH & Co. KG, Nettetal, Germany

[21] Appl. No.: 09/164,469

[22] Filed: Oct. 1, 1998

[30] Foreign Application Priority Data

Oct. 1, 1997 [DE] Germany ..... 197 43 404

[51] Int. Cl.[7] ..... C11C 5/00; C11C 5/02

[52] U.S. Cl. ..... 29/428; 264/330

[58] Field of Search ..... 29/428; 264/330; 425/803; 249/81

[56] References Cited

U.S. PATENT DOCUMENTS

| | | | |
|---|---|---|---|
| 2,468,539 | 4/1949 | Berger . | |
| 2,520,682 | 8/1950 | Harrison et al. . | |
| 3,702,495 | 11/1972 | Renoe . | |
| 3,759,478 | 9/1973 | Schmitt et al. | 425/803 |
| 3,958,909 | 5/1976 | Estrugo | 425/803 |
| 3,998,922 | 12/1976 | Weiss | 425/803 |
| 4,022,862 | 5/1977 | McBride et al. . | |
| 4,086,046 | 4/1978 | Brown et al. . | |
| 5,939,005 | 8/1999 | Materna | 425/803 |

FOREIGN PATENT DOCUMENTS 1 467 714 1/1969 Germany .

*Primary Examiner*—S. Thomas Hughes
*Assistant Examiner*—Eric Compton
*Attorney, Agent, or Firm*—Herbert Dubno; Andrew Wilford

[57] ABSTRACT

A candle is made by first positioning a core element centrally in an upwardly open candle mold with the element spaced from an inner wall surface of the mold and from a lower wall of the mold, then extending a thin rod up through the lower wall of the mold to a position at least at a lower end of the core element in the mold, and then filling the mold around the core element and rod with molten wax. This wax is then cooled and hardened around the core element and rod to a hard body and the core is withdrawn upward out of the hard body to leave a central cavity in the body. The hard body is pushed up out of the mold and off the thin rod to leave in a lower end of the body where the rod was a passage extending to the central cavity. Finally a wick is fitted to the cavity and passage and the cavity is filled around the wick with wax. This last step can be carried out by fitting to the cavity a small-diameter hard body of wax itself molded around the wick. Alternately it is done by first advancing the rod to a position projecting upward out of the mold, then filling the cavity around the rod with molten wax, and then cooling and hardening the wax in the cavity around the wick. The hardened wax is then separated from the rod so as to leave a passage in the hardened wax and a wick is fitted to the passage.

7 Claims, 3 Drawing Sheets

MAKING CANDLES

FIELD OF THE INVENTION

The present invention relates to the making of candles. More particularly this invention concerns a method of and apparatus for making candles.

BACKGROUND OF THE INVENTION

A candle is typically made by orienting a wick at the center of a normally upright and downwardly closed candle mold, then filling the mold around the wick with molten wax, cooling the wax until it hardens around the wick, and then pushing the finished candle out of the mold. Such a procedure can be speeded up considerably by providing means for cooling the candle mold so as to reduce the time it takes the wax to harden.

At best this operation, which is producing a high-volume item that must be made at the lowest possible cost, is slow. The time spent waiting for the wax to harden is, even in a system with supplemental cooling, greater than the time necessary to fill and empty the mold.

OBJECTS OF THE INVENTION

It is therefore an object of the present invention to provide an improved method of and apparatus for making candles.

Another object is the provision of such an improved method of and apparatus for making candles which overcomes the above-given disadvantages, that is which allows the wax-hardening time to be reduced to a bare minimum.

SUMMARY OF THE INVENTION

A method of making a candle has according to the invention the steps of first positioning a core element centrally in an upwardly open candle mold with the element spaced from an inner wall surface of the mold and from a lower wall of the mold, then extending a thin rod up through the lower wall of the mold to a position at least at a lower end of the core element in the mold, and then filling the mold around the core element and rod with molten wax. This wax is then cooled and hardened around the core element and rod to a hard body and the core is withdrawn upward out of the hard body to leave a central cavity in the body. The hard body is pushed up out of the mold and off the thin rod to leave in it a lower end of the body where the rod was a passage extending to the central cavity. Finally a wick is fitted to the cavity and passage and the cavity is filled around the wick with wax.

This last step can be carried out by fitting to the cavity a small-diameter hard body of wax itself molded around the wick. Alternately it is done by first advancing the rod to a position projecting upward out of the mold, then filling the cavity around the rod with molten wax, and then cooling and hardening the wax in the cavity around the wick. The hardened wax is then separated from the rod so as to leave a passage in the hardened wax and a wick is fitted to the passage.

To speed the process a cool heat-exchange medium is passed through the core element to actively cool it. The candle is ejected from the mold by pushing the lower wall of the mold up in the mold.

According to the invention the mold is preheated before filling with wax. While in the prior art the candle mold is typically flushed with water at 30° C. to 40° C. to preheat it to about 30° C. and then wax at about 80° C. is filled into it, in accordance with the invention the mold is heated to a temperature somewhat above a melting point of the wax. In addition the wax is just barely melted, not made real hot, so that less heat needs to be dissipated, normally only cooled to about 40° C. In this manner a candle 40 mm in diameter can be made in about 15 min, instead of 40 min as in the prior art.

Preferably according to the invention the mold is preheated to a temperature of between 60° C. and 70° C. and the wax is filled into the mold at a temperature of about 65° C.

The candle-making apparatus according to the invention has a mold having a bottom wall and a side wall together forming an upwardly open and vertically elongated compartment, a core element of a size substantially narrower and shorter than the compartment displaceable into a position engaged in the mold at a spacing from its bottom and side walls, and a thin rod extendable through the bottom wall to a position at least at a lower end of the core element in the mold. Means is provided for filling the mold around the element and rod with molten wax, and for lifting the bottom wall and pushing the wax upward out of the mold.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
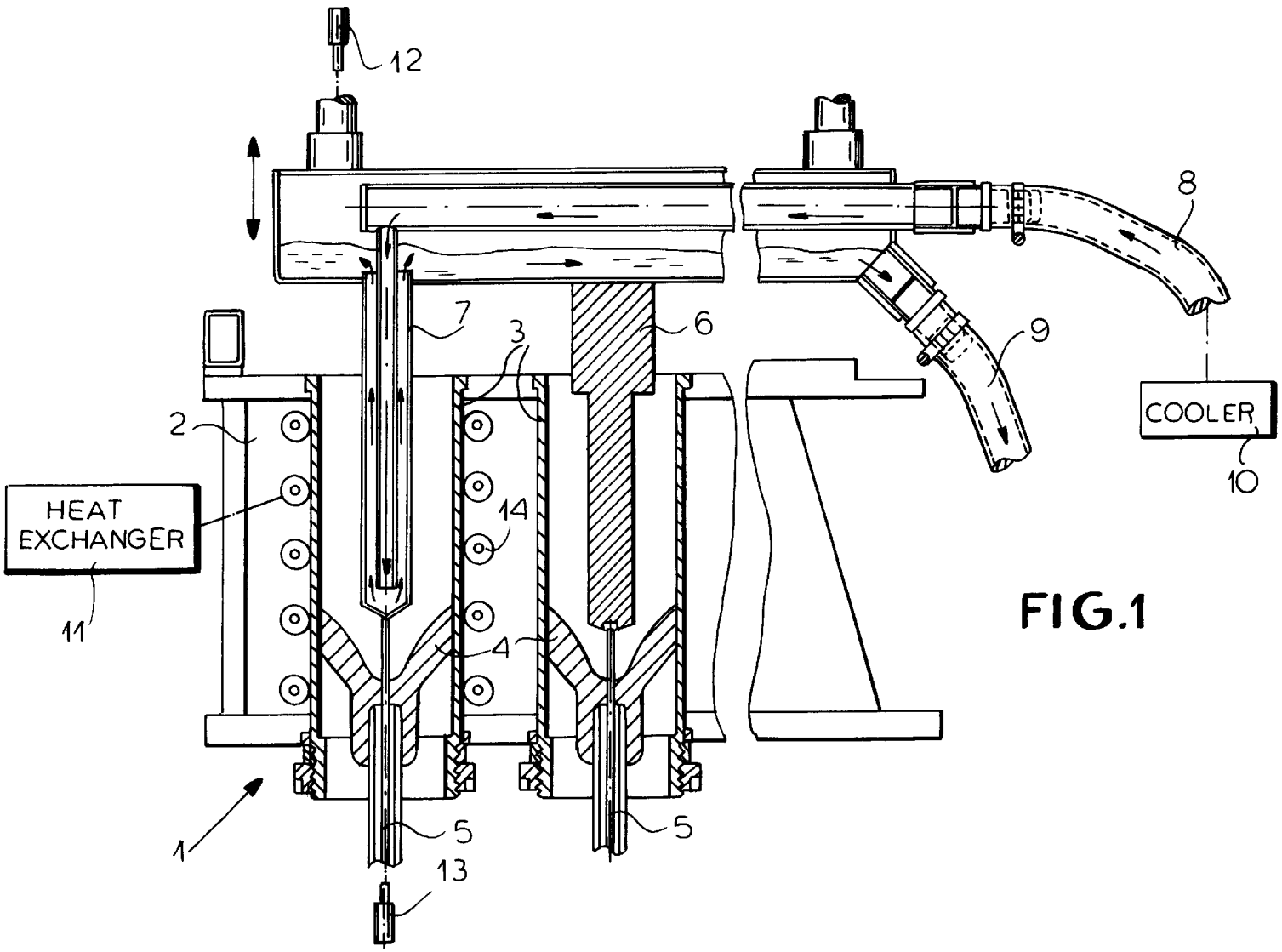
FIG. 1 is a partly diagrammatic and sectional side view of the apparatus according to the invention.

As seen in FIG. 1 a candle-making apparatus 1 according to the invention has a frame 2 supporting a plurality of like molds 3 each of upwardly open cylindrically tubular shape and each having an upwardly flaring frustoconical piston floor 4. The molds 3 can each spacedly receive a solid core element 6 formed as a stepped cylindrical body or a hollow core element 7 connected to conduits 8 and 9 in turn connected to a cooler 10 so that a coolant can be flowed through it. These elements 6 and 7 can be raised and lowered into the molds by an actuator shown schematically at 12 and a thin wick rod 5 can similarly be pushed up through the lower walls or pistons 4 by an actuator shown schematically at 13. A heat exchanger 11 can be connected to tubing 14 wrapped around the molds 3 to heat and/or cool them.

Figure 4:
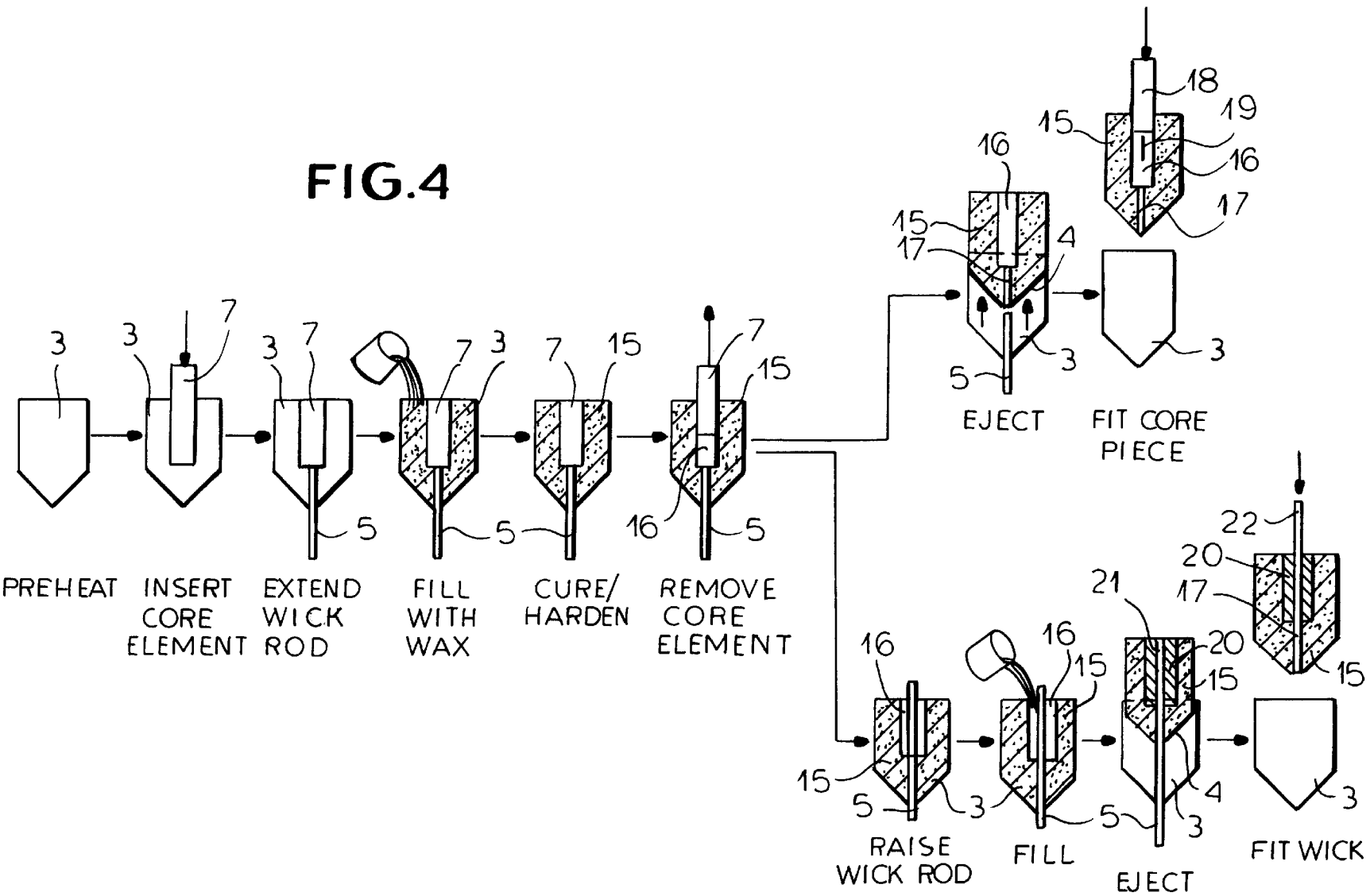
FIG. 4 is a small-scale schematic representation illustrating the methods of this invention.

As shown in FIG. 4 a candle is make by first preheating the mold 3 and inserting a core element 7 into it. Then the wick rod 5 is extended up so that it touches the bottom of the element 3, although if the element 3 is formed with an axial centered bore the rod 5 can be advanced so that it projects up beyond the upper end of the mold 3. Then the mold 3 is filled with wax which is cured into a hard body 15. The core 7 is then retracted to form a centered cavity 16 in the body 15.

Then as shown in the upper portion of FIG. 4 the body 15 is ejected from the mold 3 by raising the floor 4, thereby pushing the body 15 off the rod 5 to leave a thin passage 17 opening at a lower end of the body 15 and into the cavity 16. Finally a hard wax body which may be of the same wax as that which the body 15 is made of and which is provided with a throughgoing wick 19 is inserted into the cavity 16 so that it fills this cavity 16 and the wick 19 fits into and extends past the lower end of the passage 17, finishing the candle.

Alternately as shown in the lower portion of FIG. 4, the rod 5 is raised, if it is not already there, to a position projecting past the top of the mold 3 and then the cavity 16 is filled with wax to form in the cavity 16 a body 20 that is hardened. The floor 4 is then raised to leave a thin passage 21 through the body 20 and the passage 17 in the body 15. Finally a wick 22 is inserted through the aligned passages 21 and 17, finishing the candle.

Figure 3:
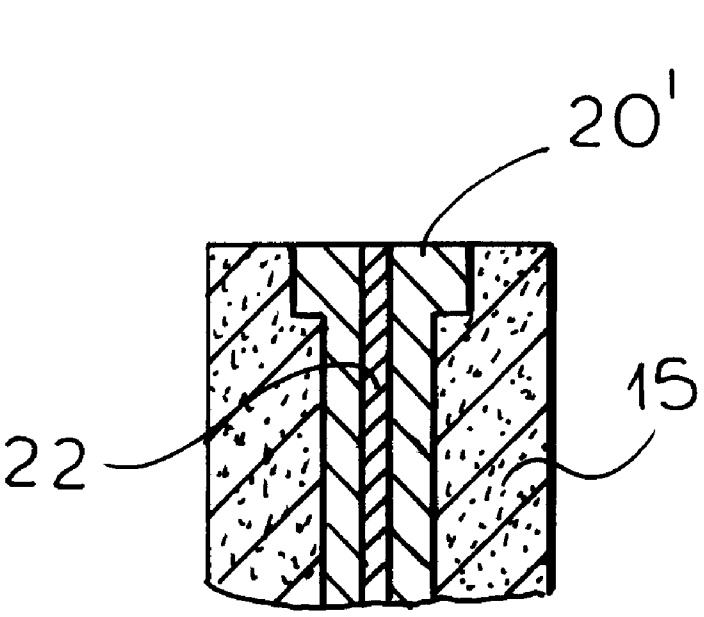
FIGS. 2 and 3 are sectional views through details of candles made in accordance with the invention.
Figure 2:
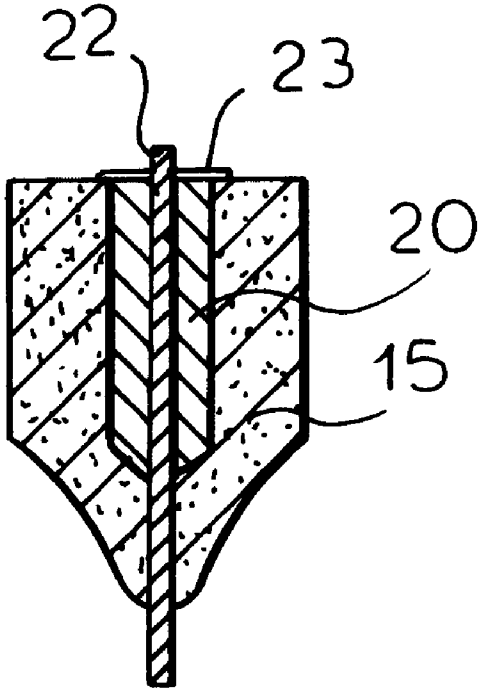

The bottom end of the wick 22 can be fitted with a disk 23 as shown in FIG. 2. If the stepped element 6 is used instead of the unstepped element 7, a stepped core body 20' is formed as shown in FIG. 3.

I claim:

1. A method of making a candle comprising the steps of:

a) positioning a core element centrally in an upwardly open candle mold with the element spaced from an inner wall surface of the mold and from a lower wall of the mold;

b) extending a thin rod up through the lower wall of the mold to a position at least at a lower end of the core element in the mold;

c) filling the mold around the core element and rod with molten wax;

d) cooling and hardening the wax around the core element and rod to form a hard body;

e) withdrawing the core element upward out of the hard body and thereby leaving a central cavity in the body;

f) pushing the hard body up out of the mold and off the thin rod, thereby leaving in a lower end of the body where the rod was a passage extending to the central cavity; and g) fitting a wick to the cavity and passage and filling the cavity around the wick with wax.

2. The candle-making method defined in claim 1 wherein step g) is carried out by fitting to the cavity a small-diameter hard body of wax itself molded around the wick.

3. The candle-making method defined in claim 1 wherein step g) is carried out by sequentially $g^1$) advancing the rod to a position projecting upward out of the mold;

$g^2$) filling the cavity around the rod with molten wax;

$g^3$) cooling and hardening the wax in the cavity around the wick;

$g^4$) separating the hardened wax from the rod and thereby leaving a passage in the hardened wax; and $g^5$) fitting a wick to the passage.

4. The candle-making method defined in claim 1, further comprising the step of a') passing a cool heat-exchange medium through the core element to actively cool it.

5. The candle-making method defined in claim 1 wherein step f) is carried out by pushing the lower wall of the mold up in the mold.

6. The candle-making method defined in claim 1, further comprising the step before step c) of preheating the mold to a temperature above a melting point of the wax.

7. The candle-making method defined in claim 6 wherein the mold is heated before step c) to a temperature of between 60° C. and 70° C. and the wax is filled into the mold at a temperature of about 65° C.

* * * * *